US007988456B2

(12) United States Patent
Davis et al.

(10) Patent No.: US 7,988,456 B2
(45) Date of Patent: Aug. 2, 2011

(54) ORTHOGONAL CONNECTOR SYSTEM

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 290 days.

(21) Appl. No.: 12/353,550

(22) Filed: Jan. 14, 2009

(65) Prior Publication Data

US 2010/0178779 A1 Jul. 15, 2010

(51) Int. Cl.
*H01R 12/00* (2006.01)

(52) U.S. Cl. ..... 439/65

(58) Field of Classification Search ..... 439/607.08, 439/79, 108, 65, 544, 61, 701, 485, 607.01, 439/941, 101, 939; 361/788
See application file for complete search history.

(56) References Cited

U.S. PATENT DOCUMENTS

| | | | | |
|---|---|---|---|---|
| 4,703,394 | A | 10/1987 | Petit et al. | |
| 5,429,521 | A | 7/1995 | Morlion et al. | |
| 6,227,882 | B1 | 5/2001 | Ortega et al. | |
| 6,347,962 | B1 | 2/2002 | Kline | |
| 6,371,773 | B1 | 4/2002 | Crofoot et al. | |
| 6,447,340 | B1 | 9/2002 | Wu | |
| 6,607,401 | B1 | 8/2003 | Weaver, Jr. et al. | |
| 6,607,402 | B2 | 8/2003 | Cohen et al. | |
| 6,717,825 | B2 | 4/2004 | Volstorf | |
| 6,758,695 | B2 | 7/2004 | Pepe et al. | |
| 6,780,059 | B1 | 8/2004 | Payne et al. | |
| 6,851,980 | B2 * | 2/2005 | Nelson et al. | 439/607.05 |
| 6,988,902 | B2 | 1/2006 | Winings et al. | |
| 7,108,556 | B2 | 9/2006 | Cohen et al. | |
| 7,118,391 | B2 * | 10/2006 | Minich et al. | 439/79 |
| 7,331,802 | B2 | 2/2008 | Rothermel et al. | |
| 7,500,871 | B2 * | 3/2009 | Minich et al. | 439/544 |
| 2004/0092140 | A1 | 5/2004 | Mashiyama et al. | |
| 2004/0224559 | A1 * | 11/2004 | Nelson et al. | 439/608 |
| 2005/0148239 | A1 | 7/2005 | Hull et al. | |
| 2006/0024984 | A1 | 2/2006 | Cohen et al. | |
| 2006/0073709 | A1 | 4/2006 | Reid | |

FOREIGN PATENT DOCUMENTS

| | | |
|---|---|---|
| EP | 1049201 | 11/2000 |
| EP | 1220361 | 7/2002 |
| EP | 1398852 | 3/2004 |

* cited by examiner

*Primary Examiner* — Edwin A. Leon

(57) ABSTRACT

An orthogonal connector system for connecting a first circuit board and a second circuit board oriented orthogonally with respect to the first circuit board includes a receptacle assembly and a header assembly mated with the receptacle assembly. The receptacle assembly is connected to the first circuit board and the header assembly is connected to the second circuit board. The receptacle assembly and the header assembly both have a housing and contact modules held within the corresponding housing. The contact modules have contact tails extending from a mounting edge thereof, where the contact tails of the receptacle connector are connected to the first circuit board and the contact tails of the header assembly are connected to the second circuit board. The contact modules have mating contacts extending from a mating edge thereof, where the mating edges are generally orthogonal with respect to the mounting edges. The mating contacts of the receptacle assembly are directly connected to the mating contacts of the header assembly. The mounting edge of the receptacle assembly is generally orthogonal with respect to the mounting edge of the header assembly.

20 Claims, 13 Drawing Sheets

ORTHOGONAL CONNECTOR SYSTEM

BACKGROUND OF THE INVENTION

The subject matter herein relates generally to electrical connectors, and more particularly to connectors that may be mated in an orthogonal relationship.

Some electrical systems utilize electrical connectors to interconnect two circuit boards to one another. In some applications, the circuit boards may be oriented orthogonal to one another. The electrical connectors are typically right angle connectors mounted to an edge of the circuit boards. To electrically connect the right angle connectors, a midplane circuit board is provided with front and rear header connectors on opposed front and rear sides of the midplane circuit board. The midplane circuit board is orthogonal to both of the circuit boards being connected. The front header connector receives one of the right angle connectors and the rear header connector receives the other right angle connector. The front and rear header connectors each include pins that are connected to corresponding mating contacts of the right angle connectors. The pins of the front header connector are electrically connected to the pins of the rear header connector by the midplane circuit board. For example, traces are routed along and/or through the midplane circuit board to electrically connect corresponding pins with one another.

Known electrical systems that utilize right angle connectors and header connectors mounted to a midplane circuit board are not without disadvantages. For instance, known electrical systems are prone to signal degradation due to the number of mating interfaces provided between the two circuit boards that are being connected. For example, along the signal path from one circuit board to the other circuit board includes a first board interface with the first right angle connector, the mating interface between the first right angle connector and the first header connector, a board interface between the first header connector and the midplane board, another board interface between the midplane board and the second header connector, a mating interface between the second header connector and the second right angle connector, and a board interface between the second right angle connector and the second circuit board. Signal degradation is inherent at each different interface. Additionally, some signal degradation is inherent along any portion of the contacts, pins and traces defining the signal path between the two boards. The signal degradation problems are particularly noticeable at higher signal speeds.

Some connector systems have been proposed to address the signal loss caused by transmitting signals along traces on the midplane circuit board. Such connector systems, sometimes referred to as cross connect systems, minimize the number and lengths of traces in the midplane. The connector systems can have any of several transmission line geometries, and in some cases, a coplanar transmission line geometry is used, wherein signal and grounds are arranged in a spaced apart relationship in a common plane. The header connectors are mounted on opposite sides of the midplane circuit board through vias that extend through the midplane. Such header connectors allow at least some traces to be eliminated. One example of a cross connect system is the connector system described in U.S. Pat. No. 7,331,802.

Other problems with known connector systems that utilize a midplane circuit board is the cost of the midplane circuit board and the cost of the front and rear header connectors. Costs arise from the manufacture of the components and the assembly of the components. Thus, the interconnection of orthogonal circuit boards with minimal signal loss remains a challenge.

BRIEF DESCRIPTION OF THE INVENTION

In one embodiment, an orthogonal connector system is provided for connecting a first circuit board and a second circuit board oriented orthogonally with respect to the first circuit board. The orthogonal connector system includes a receptacle assembly and a header assembly mated with the receptacle assembly. The receptacle assembly is connected to the first circuit board and the header assembly is connected to the second circuit board. The receptacle assembly and the header assembly both have a housing and contact modules held within the corresponding housing. The contact modules have contact tails extending from a mounting edge thereof, where the contact tails of the receptacle connector are connected to the first circuit board and the contact tails of the header assembly are connected to the second circuit board. The contact modules have mating contacts extending from a mating edge thereof, where the mating edges are generally orthogonal with respect to the mounting edges. The mating contacts of the receptacle assembly are directly connected to the mating contacts of the header assembly. The mounting edge of the receptacle assembly is generally orthogonal with respect to the mounting edge of the header assembly.

Optionally, adjacent mating contacts of each contact module may be offset with respect to one another such that adjacent mating contacts are not aligned with one another. The housing of the receptacle assembly may have a mating face, where the receptacle assembly is connected to the first circuit board such that the mating face of the receptacle assembly is orthogonal to the first circuit board. The housing of the header assembly may have a mating face, where the header assembly is connected to the second circuit board such that the mating face of the header assembly is orthogonal to the second circuit board. Optionally, the contact modules of both the receptacle assembly and the header assembly may include conductors extending between the contact tails and the mating contacts. The conductors may be right angle conductors that have transition sections. The contact tails may extend in a first direction from the mounting edge, and the mating contacts may extend in the second direction from the mating edge, where the second direction is generally perpendicular with respect to the first direction. The contact tails of the receptacle assembly and the contact tails of the header assembly may be configured to transmit signals across only one mating interface defined by the corresponding mating contacts. Optionally, the contact modules may include conductors arranged in pairs. The conductors may extend between the contact tails and the mating contacts, where the pairs of conductors carry differential pair signals. Each contact module may carry more than one pair of conductors.

In another embodiment, a connector assembly is provided for an orthogonal connector system used to interconnect circuit boards oriented orthogonally with respect to one another. The connector assembly includes a housing having a mating face and contact modules held within the housing. The contact modules each have a contact module body including a mating edge and a mounting edge that is orthogonal to the mating edge. The contact modules each have conductors held by the corresponding contact module body along a conductor plane. Contact tails extend from the conductors at the mounting edge for connection to a circuit board. Mating contacts extend from the conductors at the mating edge and include a mating portion configured for mating with corresponding mating contacts of a corresponding mating connector assembly. The mating contacts are offset out of the conductor plane such that the mating portions of adjacent mating contacts are arranged on opposite sides of the conductor plane.

In a further embodiment, a connector assembly is provided including a housing having a mating interface and contact modules held within the housing. The contact modules each have a contact module body including opposed first and second sides, a mating edge and a mounting edge that is orthogonal to the mating edge. The contact modules each have conductors held by the corresponding contact module body along a conductor plane. Contact tails extend from the conductors at the mounting edge for connection to a circuit board. Mating contacts extend from the conductors at the mating edge. A shield is connected to the first side of the contact module body. The shield has a mating edge and a mounting edge. The shield has shield tails extending from the mounting edge of the shield for connection to a circuit board, and the shield has shield mating contacts extending from the mating edge of the shield.

DETAILED DESCRIPTION OF THE INVENTION

Figure 1:
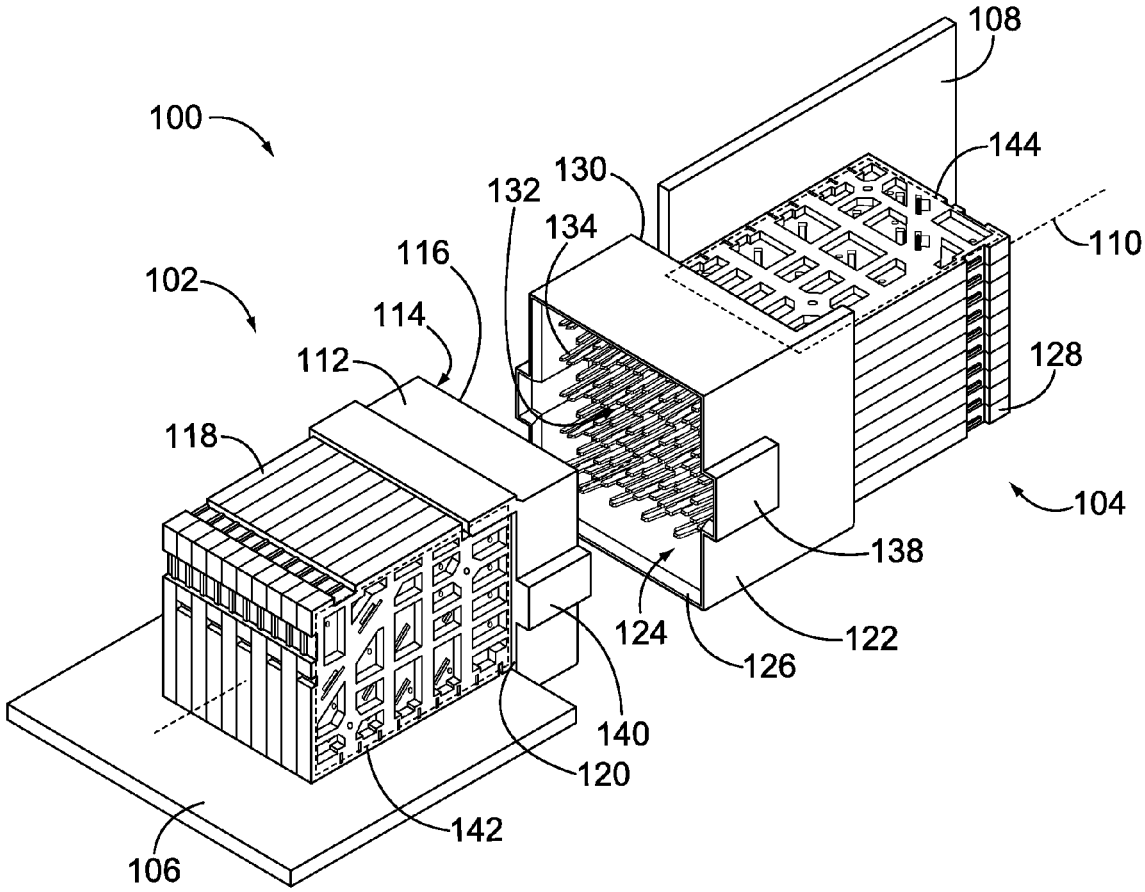
FIG. 1 is a perspective view of an orthogonal connector system formed in accordance with an exemplary embodiment illustrating a receptacle assembly and a header assembly in unmated positions.

FIG. 1 is a perspective view of an orthogonal connector system 100 formed in accordance with an exemplary embodiment illustrating two connector assemblies 102, 104 that may be directly connected to one another. The connector assemblies 102, 104 are each directly connected to first and second circuit boards 106, 108, respectively.

The connector assemblies 102, 104 are utilized to electrically connect the first and second circuit boards 106, 108 to one another without the use of a midplane circuit board. Additionally, because the connector assemblies 102, 104 are directly connected to one another, the orthogonal connector system 100 electrically connects the first and second circuit boards 106, 108 without the use of header connectors mounted to a midplane circuit board. Only one separable mating interface is provided between the first and second circuit boards 106, 108, namely the separable mating interface between the first and second connector assemblies 102, 104.

The first and second circuit boards 106, 108 are orthogonal to one another and the connector assemblies 102, 104 are orthogonal to one another. For example, one of the connector assemblies 104 is turned 90° with respect to the other connector assembly 102. A mating axis 110 extends through both the first and second connector assemblies 102, 104 and the first and second connector assemblies 102, 104 are mated with one another in a direction parallel to and along the mating axis 110. In an exemplary embodiment, both the first and second circuit boards 106, 108 extend generally parallel to the mating axis 110. The orthogonal connector system 100 electrically connects the first and second circuit boards 106, 108 without the use of a circuit board oriented perpendicular to the mating axis 110 arranged between the first and second connector assemblies 102, 104.

In the illustrated embodiment, the first connector assembly 102 constitutes a receptacle assembly, and may be referred to hereinafter as receptacle assembly 102. The second connector assembly 104 constitutes a header assembly, and may be referred to hereinafter as header assembly 104. The receptacle assembly 102 is configured for mating with the header assembly 104.

It is realized that in alternative embodiments the receptacle assembly 102 and header assembly 104 may be interchanged such that the receptacle assembly 102 may be mounted to the second circuit board 108 and header assembly 104 may be mounted to the first circuit board 106. It is also realized that different types of electrical connectors may be utilized to electrically connect the first and second circuit boards 106, 108 without the use of a midplane circuit board with corresponding header connectors mounted thereto. The different types of electrical connectors may have different shapes, form factors, mating interfaces, contact arrangements, contact types and the like in alternative embodiments. The receptacle assembly 102 and header assembly 104 are merely illustrative of an exemplary embodiment of the orthogonal connector system 100.

The receptacle assembly 102 includes a housing 112 having a mating face 114 at a front 116 of the housing 112. A plurality of contact modules 118 are held by the housing 112. The contact modules 118 are loaded through a rear 120 of the housing 112. The contact modules 118 are electrically connected to the first circuit board 106. The mating face 114 is oriented orthogonal with respect to the first circuit board 106 and the mating axis 110.

The header assembly 104 includes a housing 122 having a mating face 124 at a front 126 of the housing 122. A plurality of contact modules 128 are held by the housing 122. The contact modules 128 are loaded through a rear 130 of the housing 122. The contact modules 128 are electrically connected to the second circuit board 104. The mating face 124 is oriented perpendicular with respect to the second circuit board 108 and the mating axis 110.

The housing 122 includes a chamber 132 that receives at least a portion of the receptacle assembly 102. An array of mating contacts 134 are arranged within the chamber 132 for mating with corresponding mating contacts 136 (shown in FIG. 4) of the receptacle assembly 102. The mating contacts 134 extend from corresponding contact modules 128 into the chamber 132 when the contact modules are coupled to the housing 122. The mating contacts 134 are electrically connected to the second circuit board 108 by the contact modules 128.

The housing 122 includes alignment features 138 in the form of grooves that open at the chamber 132. The alignment features 138 are configured to interact with corresponding alignment features 140 on the housing 112 of the receptacle assembly 102. The alignment features 140 on the housing 112 are in the form of projections that extend outward from the housing 112. The alignment features 138, 140 may have different shapes or may be a different type in alternative embodiments. The alignment features 138, 140 are used to orient and/or guide the receptacle assembly 102 and header assembly 104 in an orthogonal orientation with respect to one another.

The contact modules 118 of the receptacle assembly 102 are each arranged along parallel receptacle assembly contact module planes 142, one of which is shown in FIG. 1. Similarly, the contact modules 128 of the header assembly 104 are each arranged along parallel header assembly contact module planes 144, one of which is shown in FIG. 1. The receptacle assembly contact module planes 142 are oriented generally perpendicular with respect to the header assembly contact module planes 144. The receptacle assembly contact module planes 142 are oriented generally parallel with respect to the second circuit board 108. The header assembly contact module planes 144 are oriented generally parallel with respect to the first circuit board 106.

Figure 2:
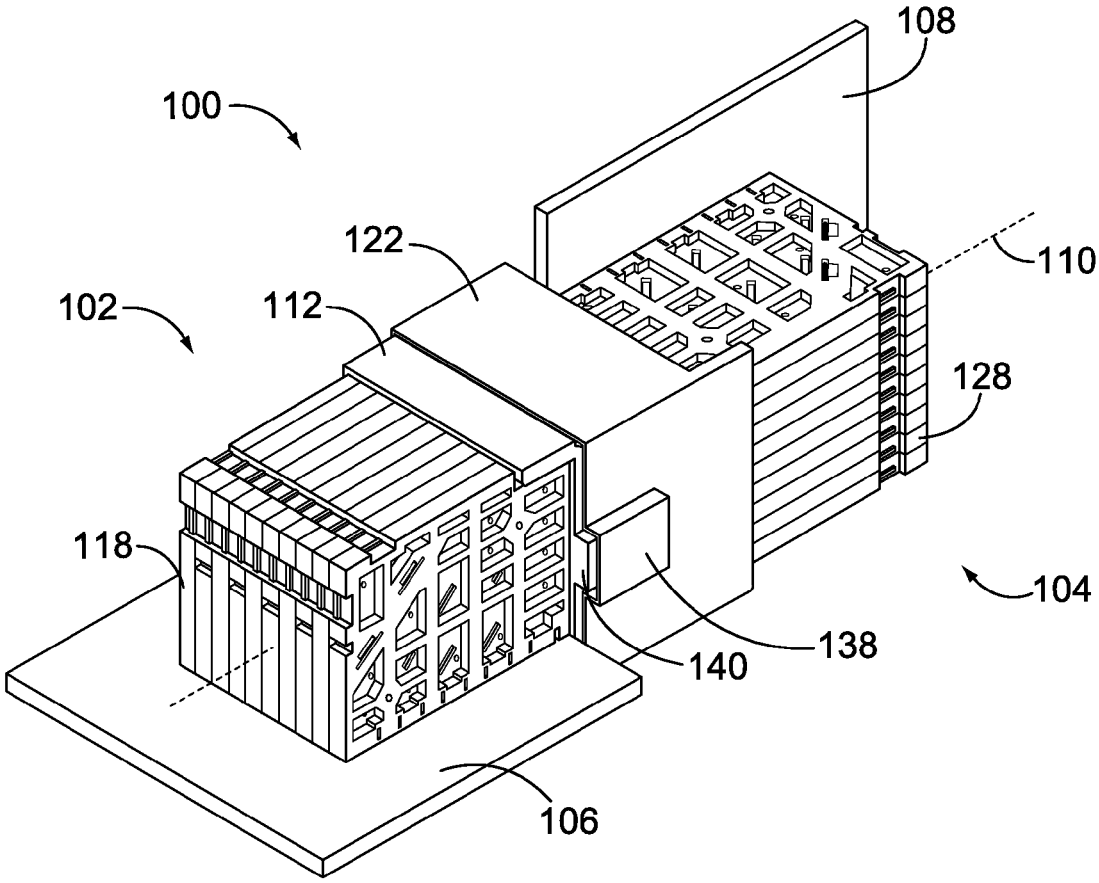
FIG. 2 is a perspective view of the orthogonal connector system shown in FIG. 1 with the receptacle assembly and the header assembly in a mated position.

FIG. 2 is a perspective view of the orthogonal connector system 100 in a mated position. During mating, at least one of the receptacle assembly 102 and header assembly 104 are moved towards the other along the mating axis 110 until the receptacle assembly 102 and header assembly 104 are mated with one another. When mated, an electrical connection is established between the receptacle assembly 102 and header assembly 104, and a corresponding electrical connection is established between the first and second circuit boards 106, 108. Optionally, either the receptacle assembly 102 or the header assembly 104 may be in a fixed position and only the other of the receptacle assembly 102 and the header assembly 104 is moved along the mating axis 110 in a mating direction. For example, the header assembly 104 may be fixed within an electronic device such as host device, a computer, a network switch, a computer server and the like, while the receptacle assembly 102 may be part of an external device being electrically connected to the electronic device, or vice versa.

When mated, the housing 112 is received within the housing 122. The alignment features 138, 140 cooperate with one another to guide the housings 112, 122 during mating. In another alternative embodiment, the alignment features 138, 140 may represent polarization or keying features that are configured to align the housings 112, 122 in only one mating orientation.

Figure 3:
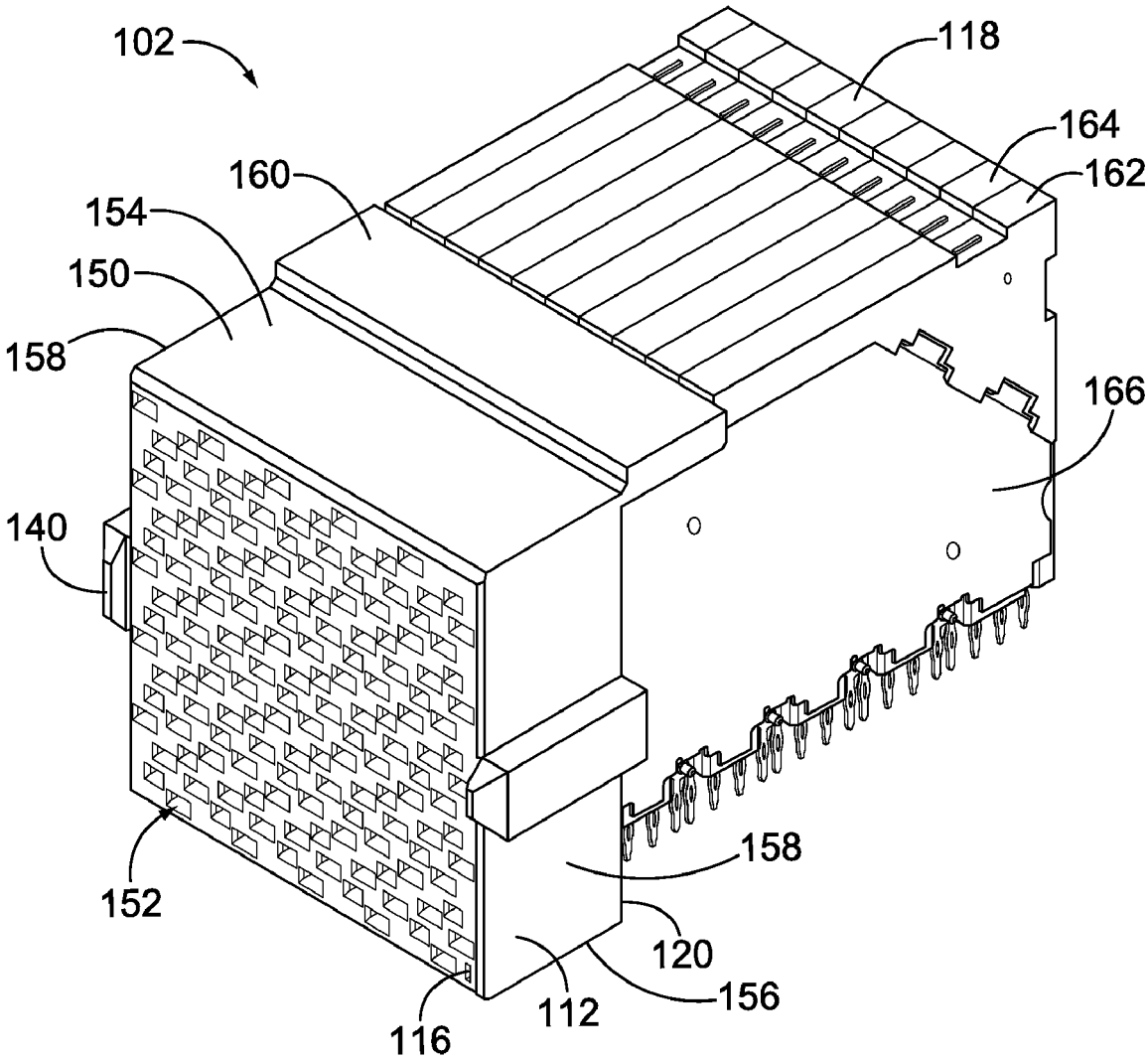
FIG. 3 is a front perspective view of the receptacle assembly shown in FIG. 1.

FIG. 3 is a front perspective view of the receptacle assembly 102 illustrating the contact modules 118 coupled to the housing 112. The housing 112 includes a base 150 extending between the front 116 and the rear 120. A plurality of contact channels 152 extend through the base 150. The contact channels 152 receive the mating contacts 136 (shown in FIG. 4). The contact channels 152 are arranged in a pattern that complements the pattern of mating contacts 136. The base 150 includes a top 154 and a bottom 156. The base 150 includes opposed sides 158 that extend between the top 154 and the bottom 156. Optionally, the alignment features 140 may be provided on the sides 158. Alternatively, the alignment features 140 may be provided on the top 154 and/or the bottom 156. A shroud 160 extends rearward from the rear 120 of the housing 112. The shroud 160 may be used to guide and/or hold the contact modules 118. The contact modules 118 are coupled to the rear 120 of the housing 112. Optionally, at least a portion of the contact modules 118 may be loaded into the rear 120 and secured thereto.

In an exemplary embodiment, multiple contact modules 118 are used. Each of the contact modules 118 may be identical to one another, or alternatively different types of contact modules 118 may be used. For example, in the illustrated embodiment, two different types of contact modules 118 are utilized, namely "A" type contact modules 162 and "B" type contact modules 164. The contact modules 162, 164 are arranged in an alternating sequence with five "A" type contact modules 162 and five "B" type modules 164. While ten contact modules 118 are illustrated, any number of contact modules 118 may be utilized. Additionally, more than two types of contact modules 118 may be used, and the different types of contact modules 118 may be used in any order depending on the particular application.

A shield 166 may be coupled to corresponding contact modules 118. The shield 166 may be provided to enhance electrical performance of the receptacle assembly 102. The shield 166 may be grounded to the first circuit board 106 (shown in FIG. 1), the contact modules 118 and/or the header assembly 104 (shown in FIG. 1). Optionally, each contact module 118 may include a corresponding shield 166. The shields 166 may be identical to one another, or alternatively may be specific to the type of contact module 118 used.

Figure 4:
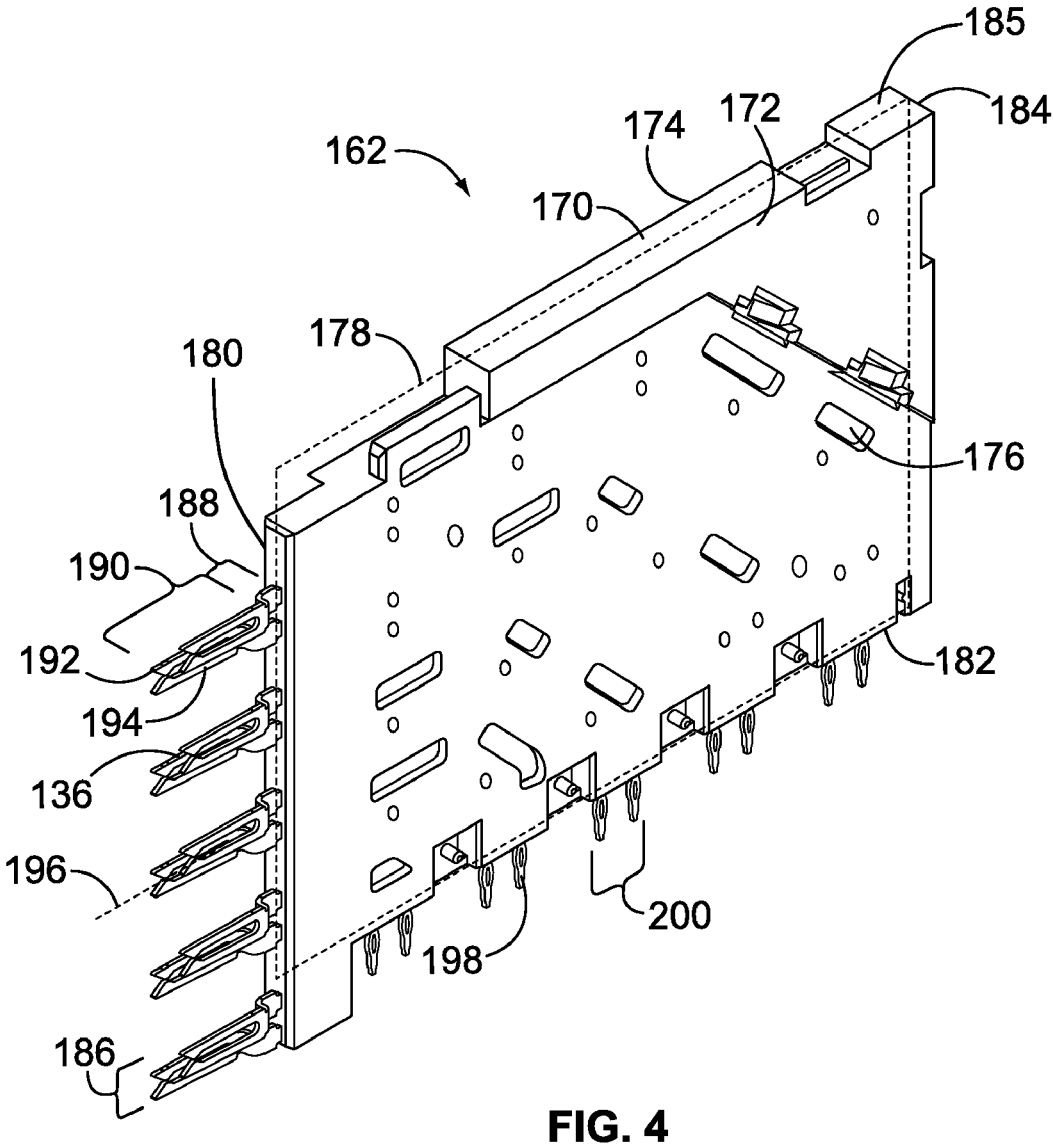
FIG. 4 is a front perspective view of a contact module for the receptacle assembly shown in FIG. 3.
Figure 6:
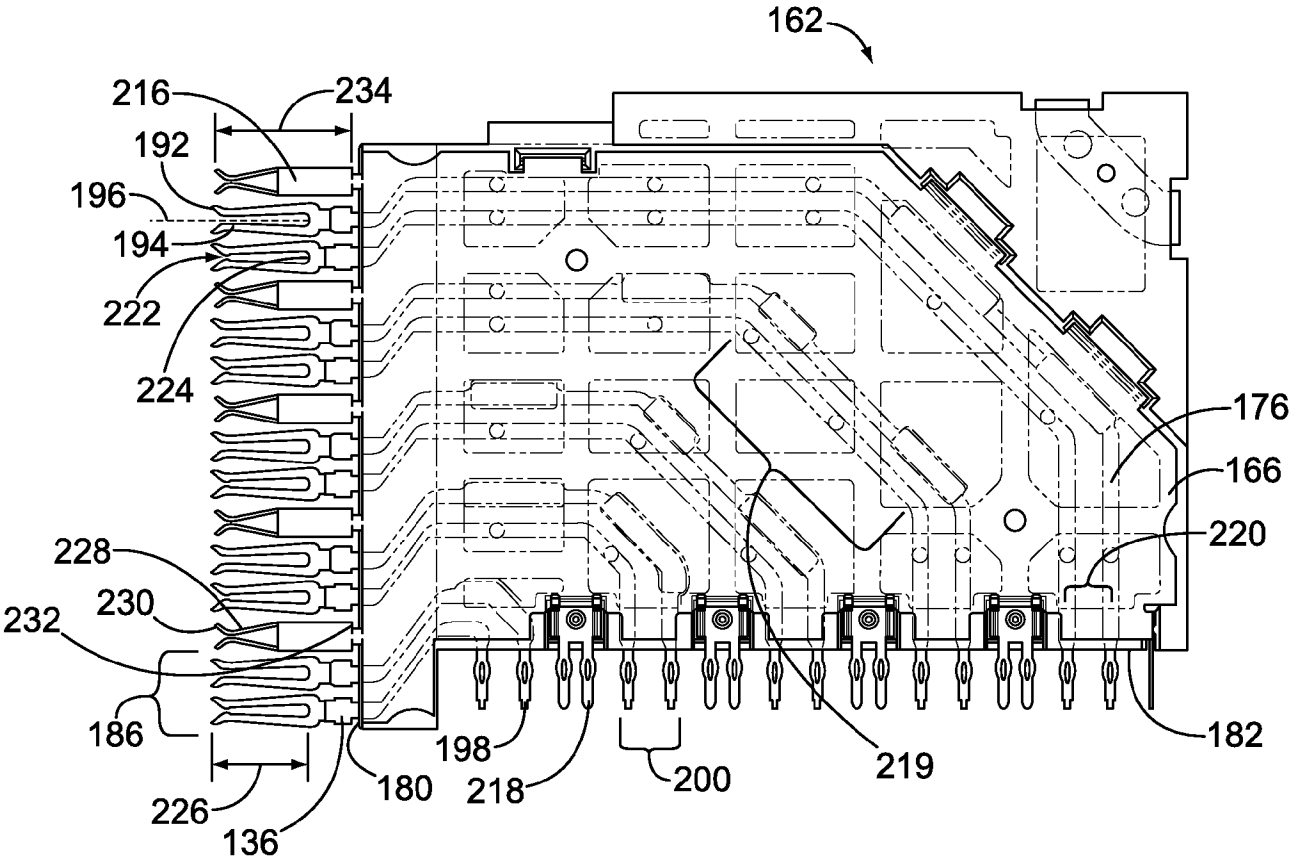
FIG. 6 is a side view of the contact module with the shield connected thereto.

FIG. 4 is a front perspective view of an "A" type of contact module 162 for the receptacle assembly 102 (shown in FIG. 3). The contact module 162 includes a contact module body 170 having opposed sides 172, 174. The contact module body 170 holds a plurality of conductors 176 therein, which are schematically illustrated in FIG. 6. In an exemplary embodiment, the conductors 176 are formed from a lead frame and the contact module body 170 is overmolded around the conductors 176. Alternatively, individual contacts representing the conductors 176 are positioned within the contact module body 170. The conductors 176 extend along and define a conductor plane 178 within the contact module body 170. The conductor plane 178 extends parallel to the sides 172, 174 of the contact module body 170. Optionally, the conductor plane 178 may be substantially centered between the sides 172, 174.

The contact module body 170 includes a forward mating edge 180 and a bottom mounting edge 182 that is orthogonal to the mating edge 180. The contact module body 170 also includes a rear edge 184 opposite the mating edge 180 and a top edge 185 opposite the mounting edge 182.

The conductors 176 generally extend between the mating edge 180 and the mounting edge 182 along the conductor plane 178. The mating contacts 136 are electrically connected to corresponding conductors 176 and extend through the mating edge 180. Optionally, the mating contacts 136 may be integrally formed with the conductors 176 as part of the lead frame. The mating contacts 136 may be signal contacts, ground contacts, power contacts and the like. In the illustrated embodiment, the mating contacts 136 are signal contacts configured to carry data signals. The mating contacts 136 may be arranged in pairs 186 and the mating contacts 136 may carry differential pair signals. Optionally, the mating contacts 136 within each pair 186 may be positioned closer to one another than to mating contacts 136 of another pair 186. Such an arrangement may more closely couple the mating contacts 136 within the pair 186 to one another than to mating contacts 136 of another pair 186. The contact module 162 has more than one pair of mating contacts 136.

The mating contacts 136 are arranged in a predetermined pattern. The pattern complements the arrangement of the mating contacts 134 of the header assembly 104 such that the mating contacts 134, 136 may be electrically connected to one another. As described above, different types of contact modules 162 may have mating contacts 134 arranged differently. For example, the "B" type contact modules 164 (shown in FIG. 3) may have a different arrangement of mating contacts 134 than the "A" type contact module 162 illustrated in FIG. 4. In the illustrated embodiment, the mating contacts 136 are shifted downward towards the bottom of the mating edge 180 of the contact module body 170 such that the mating contacts 136 are closer to the bottom of the mating edge 180 than the top of the mating edge 180. The mating contacts 136 are spaced apart from the top of the mating edge 180 by greater distance them the mating contacts 136 are spaced from the bottom.

In an exemplary embodiment, the mating contacts 136 are offset out of the conductor plane 178. The mating contacts 136 include a transition portion 188 forward of the mating edge 180 of the contact module body 170. The mating contacts 136 include a mating portion 190 forward of the transition portion 188. The mating portion 190 is configured for mating engagement with the mating contacts 134 (shown in FIG. 1) of the header assembly 104 (shown in FIG. 1). The mating portion 190 extends to an end 192 of the mating contact 136. The transition portion 188 transitions the mating contact 136 out of the conductor plane 178. For example, the transition portion 188 may be curved or bent such that the mating portion 190 is non-coplanar with the conductor plane 178. Optionally, the transition portion 188 may be curved or bent such that the mating portion 190 is parallel to the conductor plane 178. In an exemplary embodiment, the mating portion 190 is generally aligned with one of the sides 172, 174 of the contact module body 170. Optionally, the mating portions 190 of adjacent mating contacts 136 may be arranged on opposite sides of the conductor plane 178. For example, the mating contacts 136 within a pair 186 may be offset in opposite directions. In the illustrated embodiment, the mating contacts 136 are tuning-fork style contacts with a pair of beams 194 separated by a gap. The beams 194 may be equally spaced apart from a mating axis 196 along which the corresponding mating contact 134 (shown in FIG. 1) of the header assembly 104 mates with the mating contact 136. Other types or styles of contacts may be provided in alternative embodiments for mating with the mating contacts 134 of the header assembly 104.

The contact module 118 includes a plurality of contact tails 198. The contact tails 198 are electrically connected to corresponding conductors 176 and extend through the mounting edge 182. Optionally, the contact tails 198 may be integrally formed with the conductors 176 as part of the lead frame. The contact tails 198 may be signal contacts, ground contacts, power contacts and the like. In the illustrated embodiment, the contact tails 198 are signal contacts configured to carry data signals. The contact tails 198 may be arranged in pairs 200 and the contact tails 198 may carry differential pair signals. Optionally, the contact tails 198 within each pair 200 may be positioned closer to one another than to contact tails 198 of the different pair 200. Such an arrangement may more closely couple the contact tails 198 within the pair 200 to one another than to contact tails 198 of another pair 200. The contact module 162 has more than one pair of contact tails 198. In an exemplary embodiment, the contact tails 198 are generally coplanar with the conductor plane 178. The contact tails 198 may be eye-of-the-needle type contacts that fit into vias in the circuit board 106. Other types of contacts may be used for through hole mounting or surface mounting to the circuit board 106.

Figure 5:
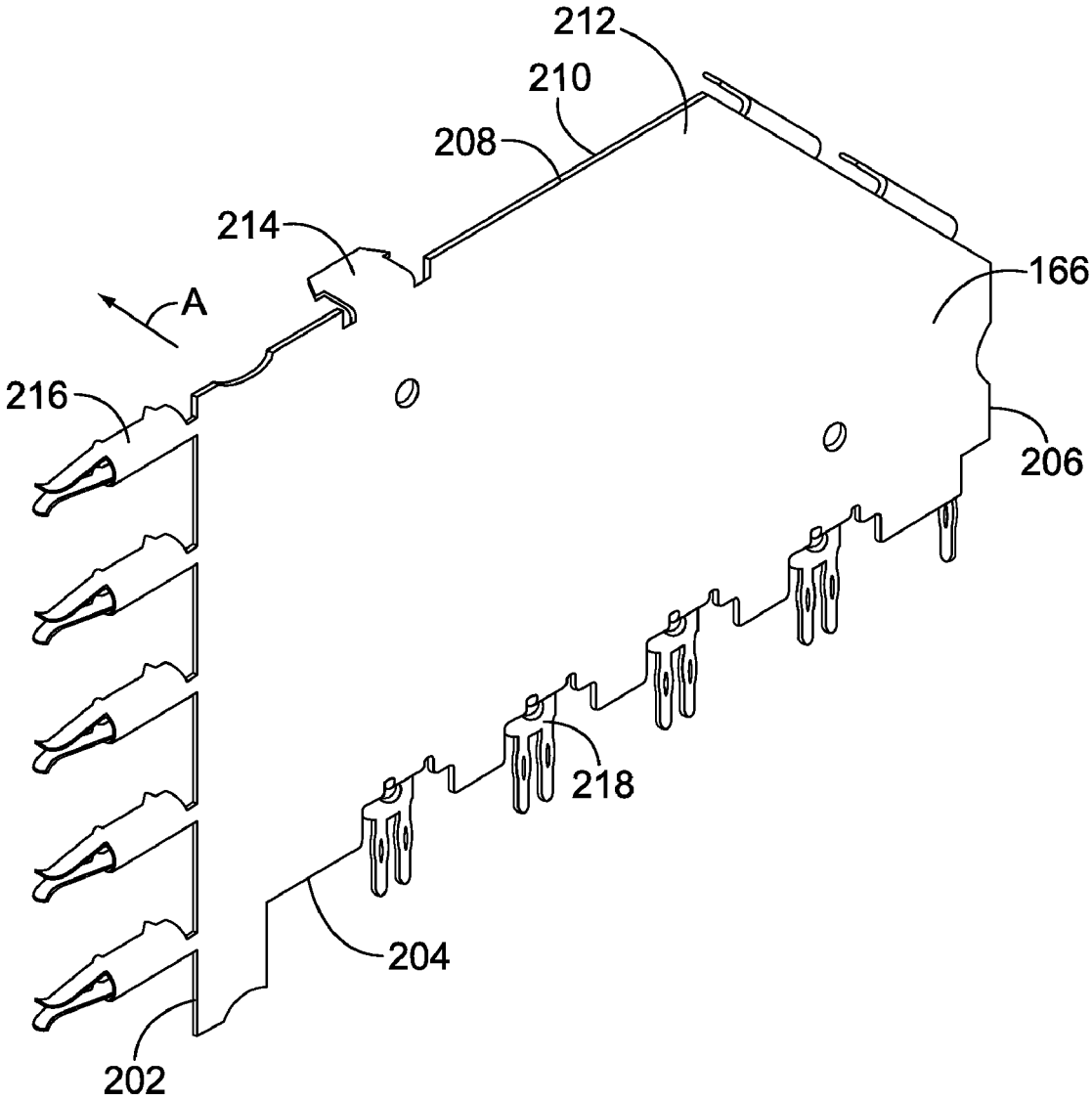
FIG. 5 is a front perspective view of a shield for the contact module shown in FIG. 4.

FIG. 5 is a front perspective view of the shield 166 for the contact module 162 (shown in FIG. 4). The shield 166 may be designed specifically for a particular type of contact module, such as the "A" type contact module 162, and may not be used with other types of contact modules, such as the "B" type contact module 164 (shown in FIG. 3). However, the shield 166 may be designed to be used with more than one type of contact module 162 or 164 in alternative embodiments.

The shield 166 includes a forward mating edge 202 and a bottom mounting edge 204 that is orthogonal to the mating edge 202. The shield 166 also includes a rear edge 206 opposite the mating edge 202 and a top edge 208 opposite the mounting edge 204. The shield 166 has an inner side 210 and an outer side 212. When mounted to the contact module 162, the inner side 210 generally faces the contact module 162 and the outer side 212 generally faces away from the contact module 162. A plurality of mounting tabs 214 may extend inwardly for connecting the shield 166 to the contact module 162.

In an exemplary embodiment, the shield 166 includes shield mating contacts 216 that extend forward from the mating edge 202. The shield mating contacts 216 extend into corresponding contact channels 152 (shown in FIG. 3) for mating engagement with corresponding shield mating contacts, ground contacts or ground pins of the header assembly 104 (shown in FIG. 1). The bulk of each shield mating contact 216 is positioned inward with respect to the shield 166, such as in the direction shown by arrow A, which is generally towards the contact module 162 when the shield 166 is coupled to the contact module 162.

The shield mating contacts 216 are arranged along the mating edge 202 in a predetermined pattern. In the illustrated embodiment, the shield mating contacts 216 are equally spaced apart from one another. The shield mating contacts 216 are shifted upward towards the top edge 208 such that the shield mating contacts 216 are more closely positioned to the top of the mating edge 202 than the bottom of the mating edge 202. The shield mating contacts 216 have a different shape than the mating contacts 136.

The shield 166 includes shield tails 218 that extend downward and inward from the mounting edge 204. The shield tails 218 may include one or more eve-of-the-needle type contacts that fit into vias in the circuit board 106. Other types of contacts may be used for through hole mounting or surface mounting to the circuit board 106. The bulk of each shield tail 218 is positioned inward with respect to the shield 166, such as in the direction shown by arrow A, which is generally towards the contact module 162 when the shield 166 is coupled to the contact module 162.

The shield tails 218 are arranged along the mounting edge 204 in a predetermined pattern. In the illustrated embodiment, the shield tails 218 are equally spaced apart from one another. The shield tails 218 are shifted rearward towards the rear edge 206 such that the shield tails 218 are more closely positioned to the rear of the mounting edge 204 than the front of the mounting edge 204.

FIG. 6 is a side view of the contact module 162 with the shield 166 connected thereto. The conductors 176 are shown in phantom between the mating contacts 136 and the contact tails 198. The conductors 176 are right angle conductors that include transition sections 219 that change the direction of the conductors 176 by approximately 90°. The contact tails 198 extend from the mounting edge 182 in a first direction and the mating contacts 136 extend from the mating edge 180 in a second direction that is generally perpendicular with respect to the first direction. The transition sections 219 transition the conductors 176 from extending generally along the first direction to generally along the second direction. In the illustrated embodiment, each of the conductors 176 represent signal conductors that carry data signals between the mating contacts 136 and the contact tails 198. No ground or power conductors are provided, however in alternative embodiments, the conductors 176 may be signal conductors, ground conductors, power conductors and the like depending on the particular application. The conductors 176 are arranged in pairs 220, where the conductors 176 within each pair 220 may be positioned closer to one another than to conductors 176 of another pair 220. Such an arrangement may more closely couple the conductors 176 within the pair 220 to one another than to other adjacent conductors 176 of another pair 220. The contact module 162 has more than one pair of conductors 176.

When the shield 166 is coupled to the contact module 162, the shield mating contacts 216 extend forward of the mating edge 180 of the contact module 162. Additionally, the shield tails 218 extend downward from the mounting edge 182 of the contact module 162. The pattern of mating contacts 136 and shield mating contacts 216 complement one another such that the shield mating contacts 216 are positioned between adjacent pairs 186 of mating contacts 136. The contact module 162 and the shield 166 have a repeating signal-signal-ground contact pattern from the bottom of the mating edge 180 to the top of the mating edge 180. The pattern of contact tails 198 and shield tails 218 complement one another such that the shield tails 218 are positioned between adjacent pairs 200 of contact tails 198. The contact module 162 and the shield 166 have a repeating signal-signal-ground contact pattern from the front of the mounting edge 182 to the rear of the mounting edge 182.

The mating contacts 136 include the opposed beams 194 that are separated by a gap 222 that receives a corresponding mating contact 134 of the header assembly 104 (shown in FIG. 1). The beams 194 are provided on opposite sides of the mating axis 196, and the mating contact 134 is received along the mating axis 196. The gap 222 has a closed end 224 at the rear of the gap 222. The gap 222 has a length 226 measured between the open end 192 and the closed end 224.

The shield mating contacts 216 include opposed fingers 228 that extend between a front 230 and a rear 232. The fingers 228 may be separated from one another between the front 230 and the rear 232 such that the shield mating contacts 216 are configured to mate with a shield mating contact, a ground contact or a ground pin along an entire length 234 of the shield mating contacts 216. The shield mating contacts 216 may connect with the shield mating contacts, ground contacts or ground pins that may be longer than the mating contacts 134 that connect with the mating contacts 136. Due to the added length of the shield mating contacts, ground contacts or ground pins that connect with the shield mating contacts 216, the shield mating contacts, ground contacts or ground pins may be unable to connect with the type of contacts used for the mating contacts 134 as the longer the shield mating contacts, ground contacts or ground pins would potentially bottom out against the closed end 224 of the gap 222. The open rear 232 of the shield mating contacts 216 accommodate the longer shield mating contacts, ground contacts or ground pins.

Figure 7:
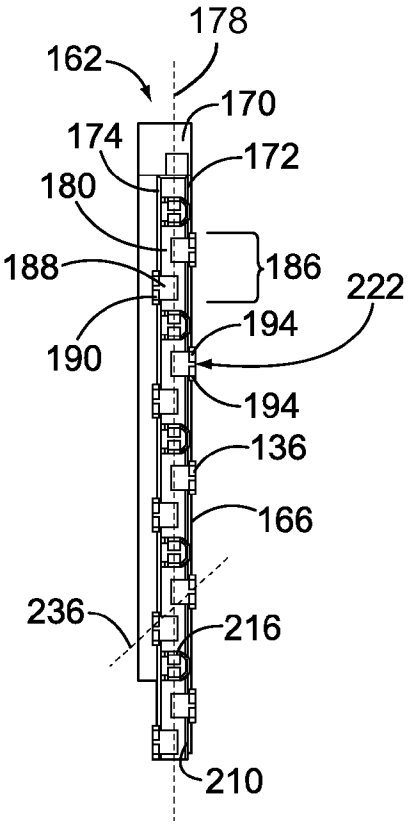
FIG. 7 is a front view of the contact module with the shield connected thereto.

FIG. 7 is a front view of the contact module 162 with the shield 166 connected thereto. The shield 166 generally extends along the side 172 of the contact module body 170 such that the inner side 210 abuts the side 172. The shield 166 is parallel to, and generally non-coplanar with the conductor plane 178. The shield mating contacts 216 extend inward from the inner side 210 such that the shield mating contacts 216 are aligned with and positioned forward of the mating edge 180 of the contact module body 170. The shield mating contacts 216 may be aligned with the conductor plane 178.

The mating contacts 136 extend from the mating edge 180 and the transition portions 188 offset the mating portions 190 from the conductor plane 178. The mating contacts 136 are offset such that adjacent mating contacts 136 are not aligned with one another. The mating portions 190 of each pair 186 are staggered on opposite sides of the conductor plane 178 toward one of the sides 172, 174 of the contact module body 170. Optionally, the mating portions 190 may be substantially aligned with one of the sides 172, 174. FIG. 7 illustrates the gap 222 between the opposed beams 194 of the mating contacts 136, along which the mating axis 196 (shown in FIG. 6) extends. A contact bisecting plane 236 is defined between the mating axes 196 of the mating contacts 136 within each pair 186. The contact bisecting plane 236 is oriented at approximately a 45° angle with respect to the conductor plane 178.

Figure 8:
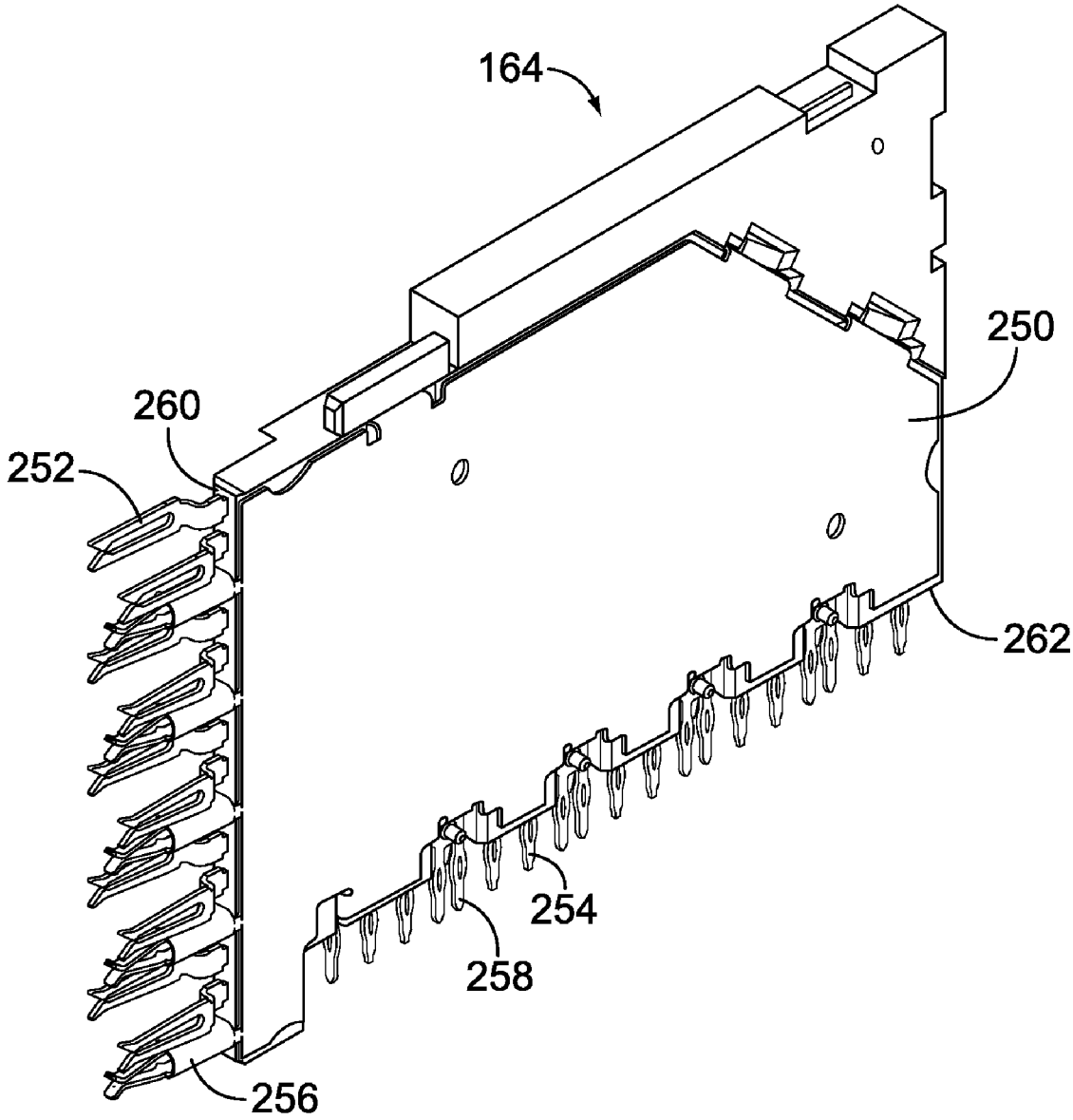
FIG. 8 is a front perspective view of another contact module and shield for the receptacle assembly shown in FIG. 3.

FIG. 8 is a front perspective view of the type "B" contact module 164 and a shield 250 for the receptacle assembly 102 (shown in FIG. 3). The contact module 164 may be substantially similar to the contact module 162 shown in FIG. 3), however the arrangement and pattern of mating contacts 252 and contact tails 254 may be different than the arrangement and pattern of mating contacts 136 (shown in FIG. 4) and contact tails 198 (shown in FIG. 4). Similarly, the shield 250 may be substantially similar to the shield 166 (shown in FIG. 3), however the arrangement and pattern of shield mating contacts 256 and shield tails 258 may be different than the arrangement and pattern of shield mating contacts 216 (shown in FIG. 5) and shield tails 218 (shown in FIG. 5).

The shield 250 is coupled to the contact module 164 such that the shield mating contacts 256 are arranged between adjacent pairs of mating contacts 252 and such that the shield tails 258 are arranged between adjacent pairs of contact tails 254. The mating contacts 252 and the shield mating contacts 256 have a repeating ground-signal-signal contact pattern from a bottom of a mating edge 260 to a top of the mating edge 260, which is different than the signal-signal-ground contact pattern of the type "A" contact module 162. The contact tails 254 and the shield tails 258 have a repeating ground-signal-signal contact pattern from a front of a mounting edge 262 to a rear of the mounting edge 262, which is different than the signal-signal-ground contact pattern of the type "A" contact module 162.

When the receptacle assembly 102 is assembled, the contact modules 162, 164 are positioned adjacent one another. The different contact patterns of the contact modules 162, 164 stagger the positions of the signal paths (e.g. the signal path may be defined by the mating contact, the conductor and/or the contact tail) such that one or more signal paths within the contact module 164 are misaligned or not aligned with a signal path of an adjacent contact module 162. The overall electrical performance of the receptacle assembly 102, which utilizes two types of contact modules 162, 164, may be enhanced as compared to a receptacle assembly that utilizes contact modules that are identical.

Figure 9:
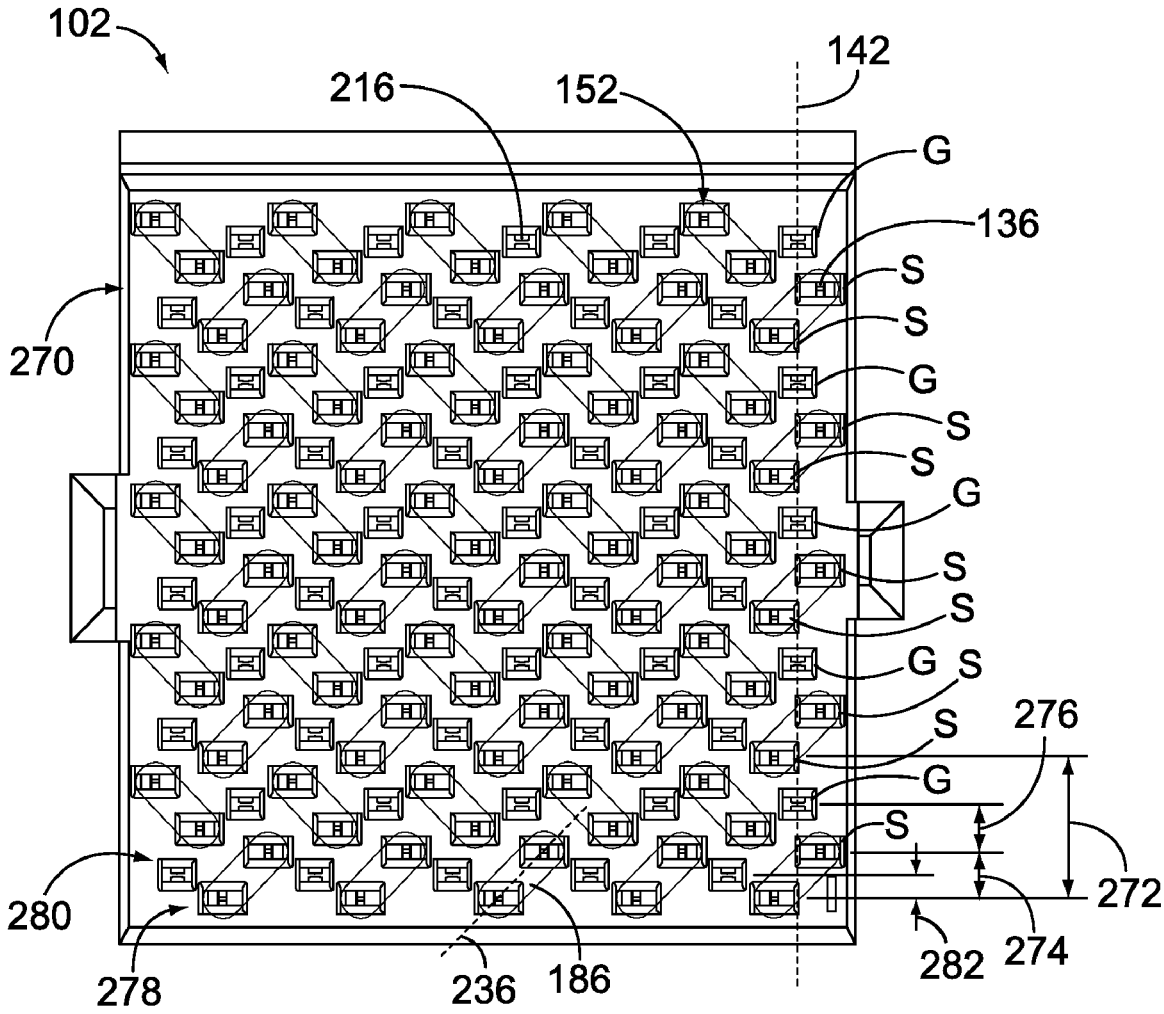
FIG. 9 is a front view of the receptacle assembly shown in FIG. 3 illustrating a mating interface thereof.

FIG. 9 is a front view of the receptacle assembly 102 illustrating a mating interface 270 thereof. FIG. 9 illustrates the mating contacts 136 and shield mating contacts 216 within the contact channels 152. The mating contacts 136 and signal mating contacts 216 from each contact module 118 (shown in FIG. 1) are arranged vertically along the receptacle assembly contact module plane 142 (one of which is shown in FIG. 9). The mating contacts 136 and the shield mating contacts 216 of the contact module 118 with the receptacle assembly contact module plane 142 identified are labeled with signal S and ground G labels, respectively. The signal pairs 186 are illustrated by oval phantom lines surrounding corresponding pairs of the mating contacts 136. The contact bisecting planes 236 between the mating contacts 136 of the pairs 186 in one contact module 118 are oriented perpendicular with respect to the contact bisecting planes 236 between the pairs in adjacent contact modules 118.

The receptacle assembly 102 has an inter-pair pitch 272 between adjacent pairs 186 of mating contacts 136. In one exemplary embodiment, the inter-pair pitch 272 may be 4.2 mm, however other pitches are possible in alternative embodiments. The receptacle assembly 102 has an intra-pair pitch 274 between the mating contacts 136 within each pair 186. In one exemplary embodiment, the intra-pair pitch 274 may be 1.4 mm, however other pitches are possible in alternative embodiments. The receptacle assembly 102 has a signal-ground contact pitch 276 between each mating contact 136 and an adjacent shield mating contact 216. Optionally, the signal-ground contact pitch 276 may be substantially the same as the intra-pair pitch 274. In one exemplary embodiment, the signal-ground contact pitch 276 may be 1.4 mm, however other pitches are possible in alternative embodiments. In an exemplary embodiment, the mating contacts 136 of one contact module 118 may be aligned with the mating contacts 136 of other contact modules 118 along contact rows 278. The shield mating contacts 216 of one contact module 118 may be aligned with the shield mating contacts 216 of other contact modules 118 along shield contact rows 280. The receptacle assembly 102 has a row pitch 282 between the contact rows 278 and the shield contact rows 280. In one exemplary embodiment, the row pitch 282 may be 0.7 mm, however other pitches are possible in alternative embodiments.

Figure 10:
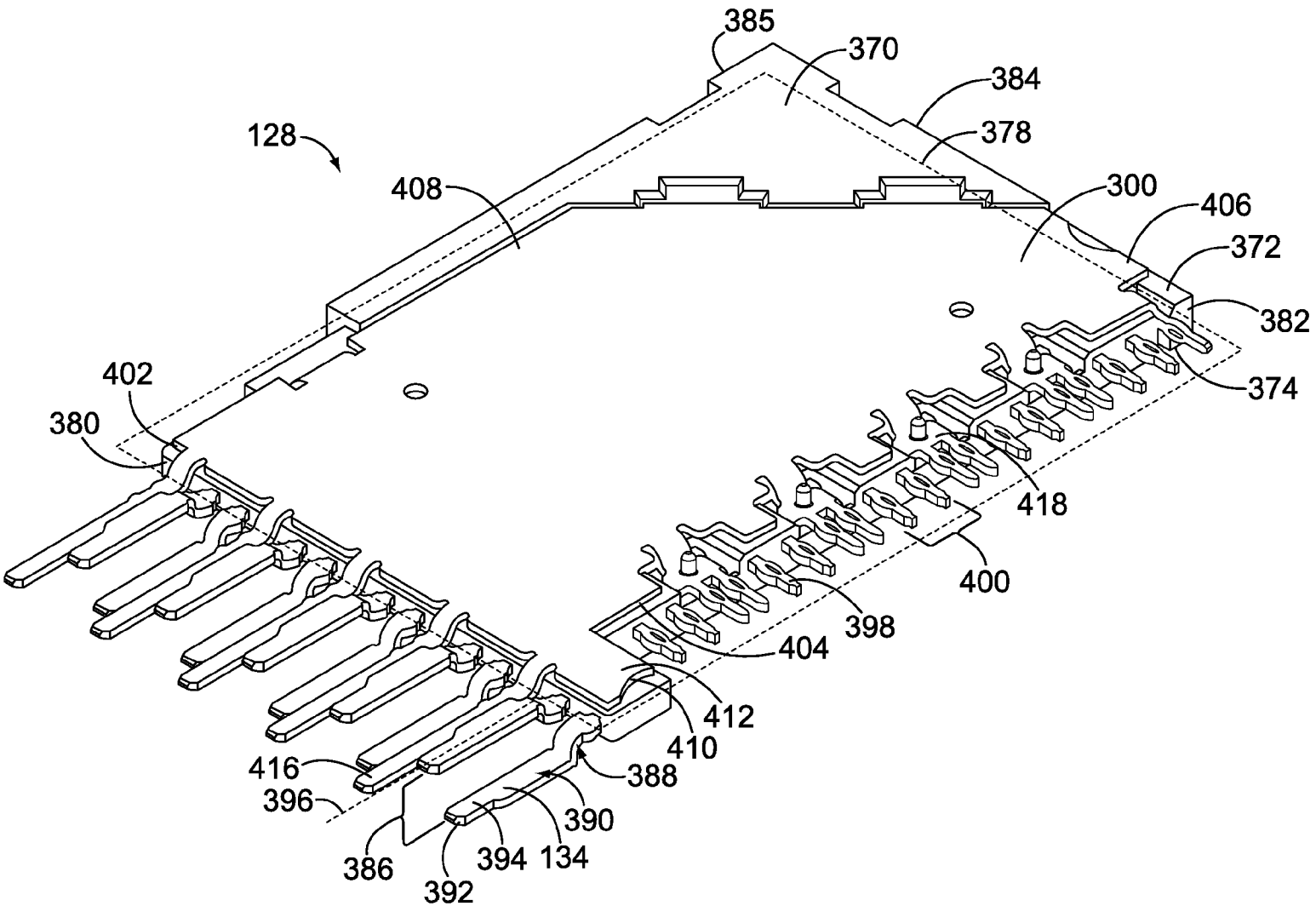
FIG. 10 is a bottom perspective view of a contact module and a shield for the header assembly shown in FIG. 1.

FIG. 10 is a bottom perspective view of the contact module 128 and a shield 300 for the header assembly 104 (shown in FIG. 1). Multiple contact modules 128 are used with the header assembly 104. Each of the contact modules 128 may be identical to one another, or alternatively different types of contact modules 128 may be used. For example, FIG. 10 illustrates one type of contact module, namely an "A" type of contact module. Another type of contact module, namely a "B" type of contact module 302 (shown in FIG. 13) may also be used within the header assembly 104. The contact modules 128, 302 may be arranged in an alternating sequence. Any number of contact modules 128 or 302 may be utilized. Additionally, more than two types of contact modules may be used, and the different types of contact modules may be used in any order depending on the particular application.

The shield 300 is coupled to a corresponding contact module 128. The shield 300 may be grounded to the second circuit board 108 (shown in FIG. 1), the contact module 128 and/or the receptacle assembly 102 (shown in FIG. 1). Optionally, the contact module 128 may be utilized without the corresponding shield 300. The contact module 128 may designed to be shieldless by incorporating at least some of the features of the shield, such as the shield mating contacts and shield tails described below.

Figure 11:
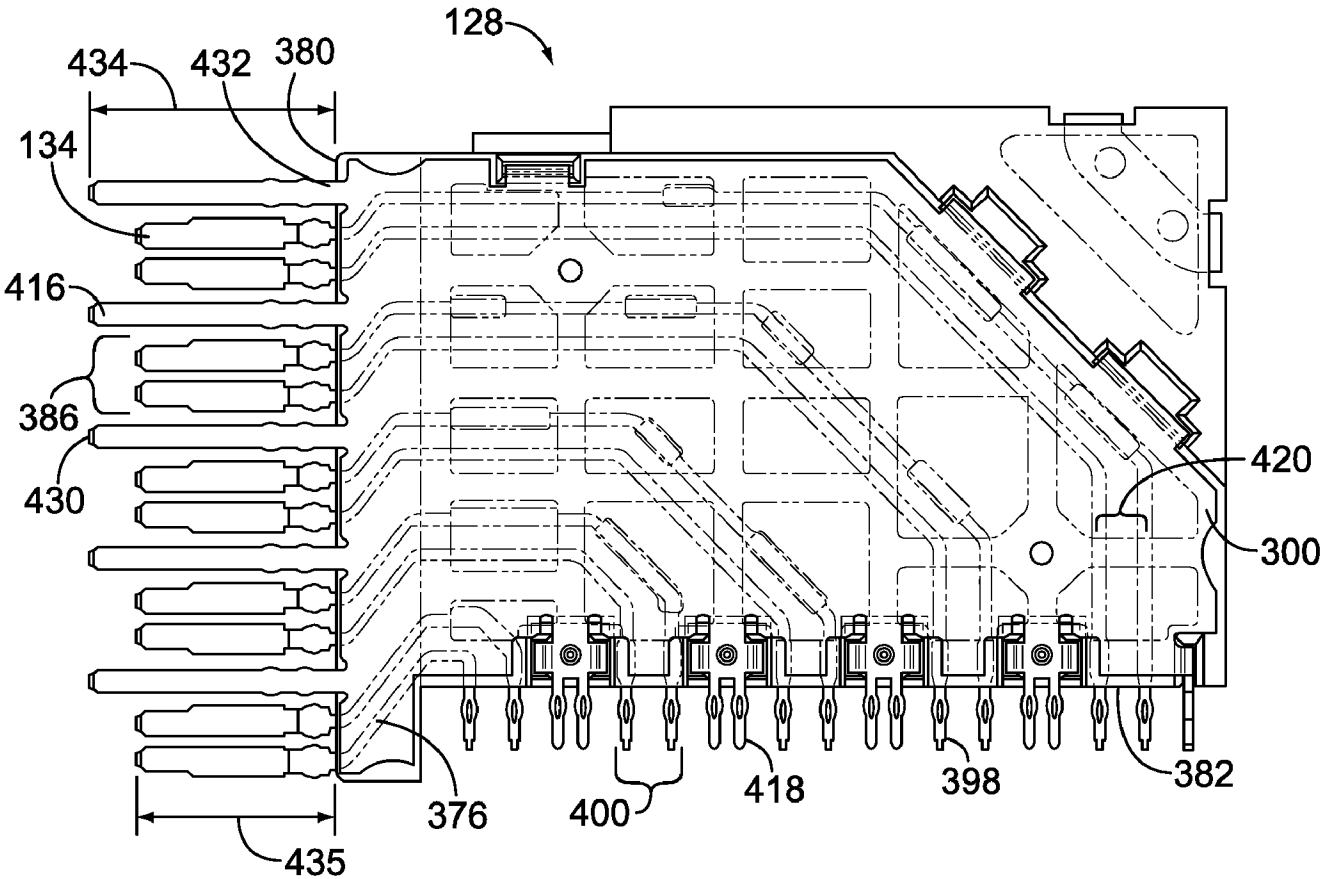
FIG. 11 is a side view of the contact module and the shield shown in FIG. 10.

The contact module 128 includes a contact module body 370 having opposed sides 372, 374. The contact module body 370 holds a plurality of conductors 376 therein, which are schematically illustrated in FIG. 11. In an exemplary embodiment, the conductors 376 are formed from a lead frame and the contact module body 370 is overmolded around the conductors 376. Alternatively, individual contacts representing the conductors 376 are positioned within the contact module body 370. The conductors 376 extend along and define a conductor plane 378 within the contact module body 370. The conductor plane 378 extends parallel to the sides 372, 374 of the contact module body 370. Optionally, the conductor plane 378 may be substantially centered between the sides 372, 374.

The contact module body 370 includes a forward mating edge 380 and a bottom mounting edge 382 that is orthogonal to the mating edge 380. The contact module body 370 also includes a rear edge 384 opposite the mating edge 380 and a top edge 385 opposite the mounting edge 382.

The conductors 376 generally extend between the mating edge 380 and the mounting edge 382 along the conductor plane 378. The mating contacts 134 are electrically connected to corresponding conductors 376 and extend through the mating edge 380. Optionally, the mating contacts 134 may be integrally formed with the conductors 376 as part of the lead frame. The mating contacts 134 may be signal contacts, ground contacts, power contacts and the like. In the illustrated embodiment, the mating contacts 134 are signal contacts configured to carry data signals. The mating contacts 134 may be arranged in pairs 386 and the mating contacts 134 may carry differential pair signals. Optionally, the mating contacts 134 within each pair 386 may be positioned closer to one another than to mating contacts 134 of another pair 386. The contact module 128 has more than one pair of mating contacts 134.

The mating contacts 134 are arranged in a predetermined pattern. The pattern complements the arrangement of the mating contacts 136 of the receptacle assembly 102 such that the mating contacts 136, 134 may be electrically connected to one another. As described above, different types of contact modules 128 may have mating contacts 134 arranged differently. For example, the "B" type contact modules 302 (shown in FIG. 13) may have a different arrangement of mating contacts 134 than the "A" type contact module 128 illustrated in FIG. 4. In the illustrated embodiment, the mating contacts 134 are shifted downward towards the bottom of the mating edge 380 of the contact module body 370 such that the mating contacts 134 are closer to the bottom of the mating edge 380 than the top of the mating edge 380. The mating contacts 134 are spaced apart from the top of the mating edge 380 by greater distance them the mating contacts 134 are spaced from the bottom.

In an exemplary embodiment, the mating contacts 134 are offset out of the conductor plane 378. The mating contacts 134 include a transition portion 388 forward of the mating edge 380 of the contact module body 370. The mating contacts 134 include a mating portion 390 forward of the transition portion 388. The mating portion 390 is configured for mating engagement with the mating contacts 136 (shown in FIG. 4) of the receptacle assembly 102. The mating portion 390 extends to an end 392 of the mating contact 134. The transition portion 388 transitions the mating contact 134 out of the conductor plane 378. For example, the transition portion 388 may be curved or bent such that the mating portion 390 is non-coplanar with the conductor plane 378. Optionally, the transition portion 388 may be curved or bent such that the mating portion 390 is parallel to the conductor plane 378. In an exemplary embodiment, the mating portion 390 is generally aligned with one of the sides 372, 374 of the contact module body 370. Optionally, the mating portions 390 of adjacent mating contacts 134 may be arranged on opposite sides of the conductor plane 378. For example, the mating contacts 134 within a pair 386 may be offset in opposite directions. In the illustrated embodiment, the mating contacts 134 are blade type contacts with opposed planar sides 394. During mating with the mating contacts 136 of the receptacle assembly 102, the mating contacts 134 are configured to be received within the gap 222 (shown in FIG. 6) between the beams 194 (shown in FIG. 6) and make electrical contact therebetween. The mating contacts 134 include a center mating axis 396 along which the corresponding mating contact 136 of the receptacle assembly 102 mates with the mating contact 134. Other types or styles of contacts may be provided in alternative embodiments for mating with the mating contacts 136.

The contact module 128 includes a plurality of contact tails 398. The contact tails 398 are electrically connected to corresponding conductors 376 and extend through the mounting edge 382. Optionally, the contact tails 398 may be integrally formed with the conductors 376 as part of the lead frame. The contact tails 398 may be signal contacts, ground contacts, power contacts and the like. In the illustrated embodiment, the contact tails 398 are signal contacts configured to carry data signals. The contact tails 398 may be arranged in pairs 400 and the contact tails 398 may carry differential pair signals. Optionally, the contact tails 398 within each pair 400 may be positioned closer to one another than to contact tails 398 of another pair 400. The contact module 128 has more than one pair of contact tails 398. In an exemplary embodiment, the contact tails 398 are generally coplanar with the conductor plane 378. The contact tails 398 may be eye-of-the-needle type contacts that fit into vias in the circuit board 108 (shown in FIG. 1). Other types of contacts may be used for through hole mounting or surface mounting to the circuit board 108.

Figure 13:
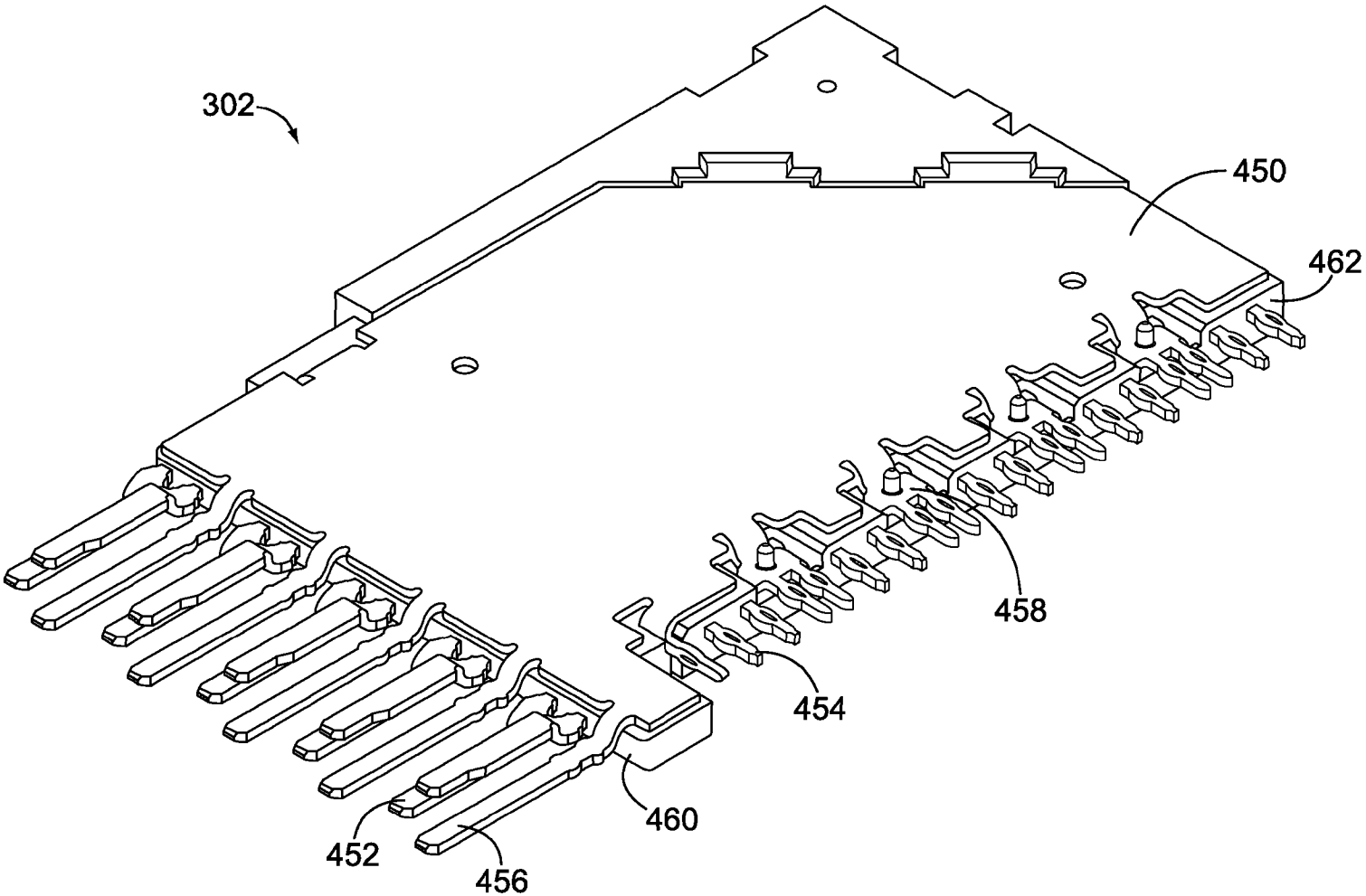
FIG. 13 is a bottom perspective view of another contact module and a shield for the header assembly shown in FIG. 1.

The shield 300 may be designed specifically for a particular type of contact module, such as the "A" type contact module 128, and may not be used with other types of contact modules, such as the "B" type contact module 302 (shown in FIG. 13). However, the shield 300 may be designed to be used with more than one type of contact module 128 or 302 in alternative embodiments.

The shield 300 includes a forward mating edge 402 and a bottom mounting edge 404 that is orthogonal to the mating edge 402. The shield 300 also includes a rear edge 406 opposite the mating edge 402 and a top edge 408 opposite the mounting edge 404. The shield 300 has an inner side 410 and an outer side 412. When mounted to the contact module 128, the inner side 410 generally faces the contact module 128 and the outer side 412 generally faces away from the contact module 128. A plurality of mounting tabs (not shown) may extend inwardly for connecting the shield 300 to the contact module 128.

In an exemplary embodiment, the shield 300 includes shield mating contacts 416 that extend forward from the mating edge 402. The shield mating contacts 416 extend into corresponding contact channels in the housing 122 (shown in FIG. 1) of the header assembly 104 for mating engagement with corresponding ground contacts, ground pins or shield mating contacts 216 (shown in FIG. 5) of the receptacle assembly 102.

The shield mating contacts 416 are arranged along the mating edge 402 in a predetermined pattern. In the illustrated embodiment, the shield mating contacts 416 are equally spaced apart from one another. The shield mating contacts 416 are shifted upward towards the top edge 408 such that the shield mating contacts 416 are more closely positioned to the top of the mating edge 402 than the bottom of the mating edge 402.

The shield 300 includes shield tails 418 that extend inward and downward from the mounting edge 404. The shield tails 418 may include one or more eye-of-the-needle type contacts that fit into vias in the circuit board 106. Other types of contacts may be used for through hole mounting or surface mounting to the circuit board 108.

The shield tails 418 are arranged along the mounting edge 404 in a predetermined pattern. In the illustrated embodiment, the shield tails 418 are equally spaced apart from one another. The shield tails 418 are shifted rearward towards the rear edge 406 such that the shield tails 418 are more closely positioned to the rear of the mounting edge 404 than the front of the mounting edge 404.

As described above, the contact module 128 may be used without the shield 300. In such embodiments, the shield mating contacts 416 and the shield tails 418 may be part of the contact module 128. Additionally, the shield mating contacts 416 and the shield tails 418 may be interconnected by conductors that are part of the leadframe and held by the contact module body 370.

FIG. 11 is a side view of the contact module 128 with the shield 300 connected thereto. The conductors 376 are shown in phantom between the mating contacts 134 and the contact tails 398. The conductors 376 are right angle conductors. The conductors 376 are arranged in pairs 420, where the conductors 376 within each pair 420 may be positioned closer to one another than to conductors 376 of another pair 420. The contact module 128 has more than one pair of conductors 376.

When the shield 300 is coupled to the contact module 128, the shield mating contacts 416 extend forward of the mating edge 380 of the contact module 128. Additionally, the shield tails 418 extend downward from the mounting edge 382 of the contact module 128. The pattern of mating contacts 134 and shield mating contacts 416 complement one another such that the shield mating contacts 416 are positioned between adjacent pairs 386 of mating contacts 134. The contact module 128 and the shield 300 have a repeating signal-signal-ground contact pattern from the bottom of the mating edge 380 to the top of the mating edge 380. The pattern of contact tails 398 and shield tails 418 complement one another such that the shield tails 418 are positioned between adjacent pairs 400 of contact tails 398. The contact module 128 and the shield 300 have a repeating signal-signal-ground contact pattern from the front of the mounting edge 382 to the rear of the mounting edge 382.

The shield mating contacts 416 are blade type contacts having planar sides that extend between a front 430 and a rear 432. The shield mating contacts 416 have a length 434 that is longer than a length 435 of the mating contacts 134. As such, the shield mating contacts 416 may connect with corresponding contacts 216 of the receptacle assembly 102 prior to the mating contacts 134 connecting with corresponding mating contacts 136. Additionally, because of the extra length, the shield mating contacts 416 may extend further into the receptacle assembly 102 during mating than the mating contacts 134. In alternative embodiments, the length 434 may be substantially the same as the length 435. Additionally, different shield mating contacts 416 may have different lengths 434.

Figure 12:
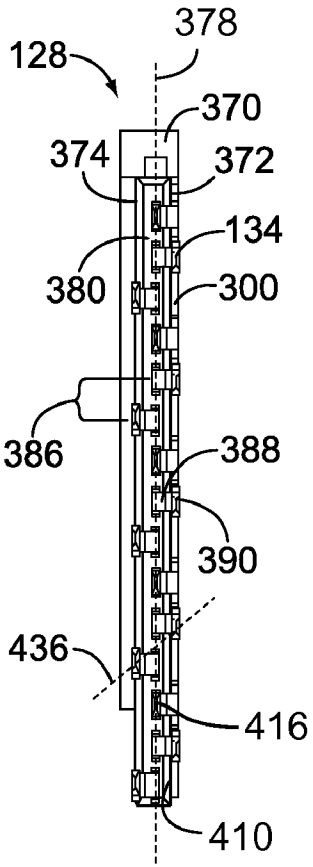
FIG. 12 is a front view of the contact module and the shield shown in FIG. 10.

FIG. 12 is a front view of the contact module 128 with the shield 300 connected thereto. The shield 300 generally extends along the side 372 of the contact module body 370 such that the inner side 410 abuts the side 372. The shield 300 is parallel to, and generally non-coplanar with the conductor plane 378. The shield mating contacts 416 extend inward from the inner side 410 such that the shield mating contacts 416 are aligned with and positioned forward of the mating edge 380 of the contact module body 370. The shield mating contacts 416 may be aligned with the conductor plane 378.

The mating contacts 134 extend from the mating edge 380 and the transition portions 388 offset the mating portions 390 from the conductor plane 378. The mating contacts 134 are offset such that adjacent mating contacts 134 are not aligned with one another. The mating portions 390 of each pair 386 are staggered on opposite sides of the conductor plane 378 toward one of the sides 372, 374 of the contact module body 370. Optionally, the mating portions 390 may be substantially aligned with one of the sides 372, 374. A contact bisecting plane 436 is defined between the central mating axes 396 (shown in FIG. 10) of the mating contacts 134 within each pair 386. The contact bisecting plane 436 is oriented at approximately a 45° angle with respect to the conductor plane 378.

FIG. 13 is a bottom perspective view of the type "B" contact module 302 and a shield 450 for the header assembly 104 (shown in FIG. 1). The contact module 302 may be substantially similar to the contact module 128 shown in FIG. 10), however the arrangement and pattern of mating contacts 452 and contact tails 454 may be different than the arrangement and pattern of mating contacts 134 (shown in FIG. 10) and contact tails 398 (shown in FIG. 10). Similarly, the shield 450 may be substantially similar to the shield 300 (shown in FIG. 10), however the arrangement and pattern of shield mating contacts 456 and shield tails 458 may be different than the arrangement and pattern of shield mating contacts 416 (shown in FIG. 10) and shield tails 418 (shown in FIG. 10).

The shield 450 is coupled to the contact module 302 such that the shield mating contacts 456 are arranged between adjacent pairs of mating contacts 452 and such that the shield tails 458 are arranged between adjacent pairs of contact tails 454. The mating contacts 452 and the shield mating contacts 456 have a repeating ground-signal-signal contact pattern from a bottom of a mating edge 460 to a top of the mating edge 460, which is different than the signal-signal-ground contact pattern of the type "A" contact module 128. The contact tails 454 and the shield tails 458 have a repeating ground-signal-signal contact pattern from a front of a mounting edge 462 to a rear of the mounting edge 462, which is different than the signal-signal-ground contact pattern of the type "A" contact module 128.

Figure 14:
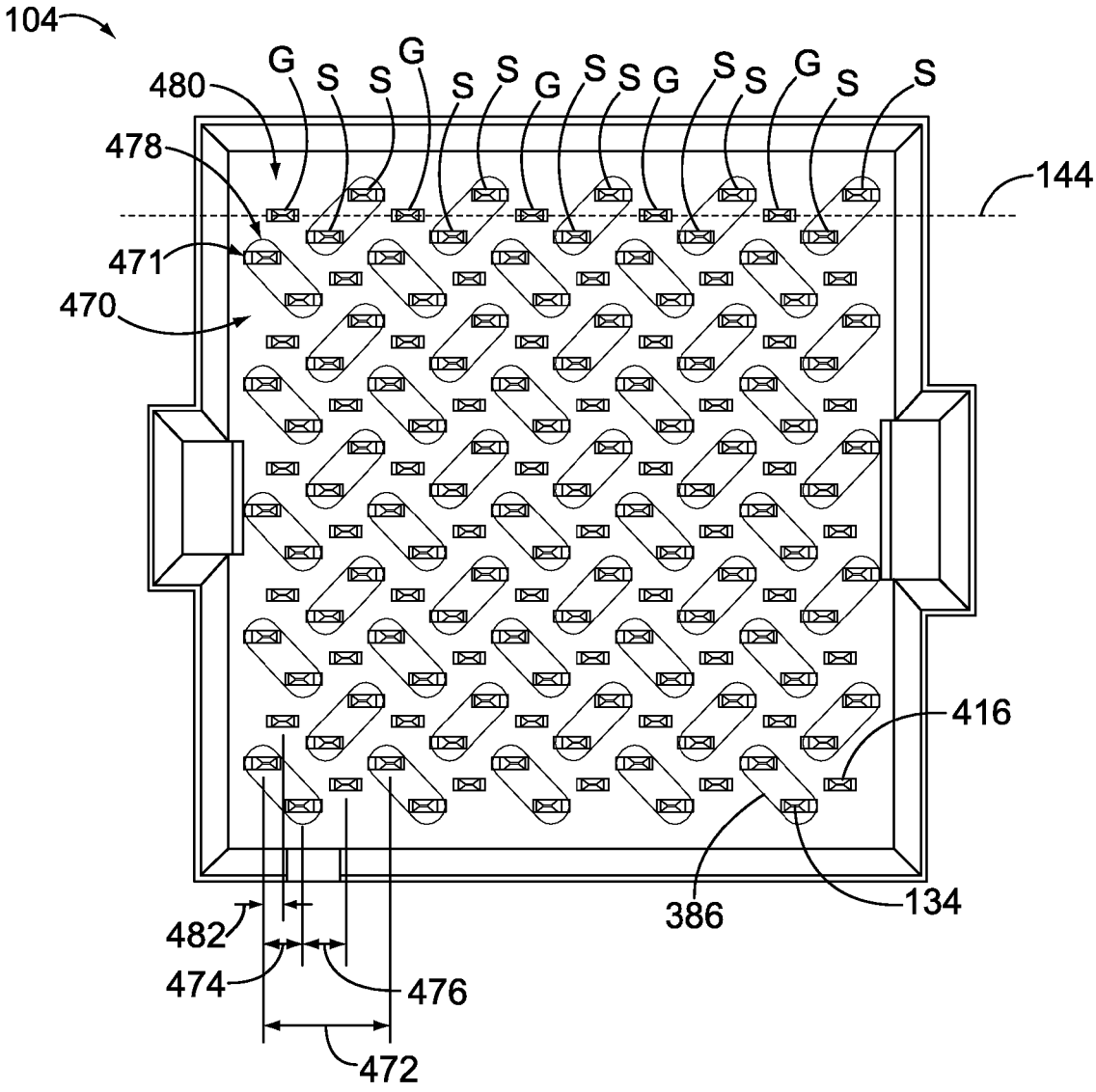
FIG. 14 is a front view of the header assembly shown in FIG. 1 illustrating a mating interface thereof.

FIG. 14 is a front view of the header assembly 104 illustrating a mating interface 470 thereof. FIG. 14 illustrates the mating contacts 134 and shield mating contacts 416 within contact channels 471. The mating contacts 134 and shield mating contacts 416 from each contact module 128 or 302 (shown in FIGS. 10 and 13, respectively) are arranged along the header assembly contact module plane 144 (one of which is shown in FIG. 14). The mating contacts 134 and the shield mating contacts 416 of the contact module 128 with the header assembly contact module plane 144 identified are labeled with signal S and ground G labels, respectively. The signal pairs 386 are illustrated by oval phantom lines surrounding corresponding pairs of the mating contacts 134.

The header assembly 104 has an inter-pair pitch 472 between adjacent pairs 386 of mating contacts 134. In one exemplary embodiment, the inter-pair pitch 472 may be 4.2 mm, however other pitches are possible in alternative embodiments. The header assembly 104 has an intra-pair pitch 474 between the mating contacts 134 within each pair 386. In one exemplary embodiment, the intra-pair pitch 474 may be 1.4 mm, however other pitches are possible in alternative embodiments. The header assembly 104 has a signal-ground contact pitch 476 between each mating contact 134 and an adjacent shield mating contact 416. Optionally, the signal-ground contact pitch 476 may be substantially the same as the intra-pair pitch 474. In one exemplary embodiment, the signal-ground contact pitch 476 may be 1.4 mm, however other pitches are possible in alternative embodiments. In an exemplary embodiment, the mating contacts 134 of one contact module 128 or 302 may be aligned with the mating contacts 134 of other contact modules 128 or 302 along contact rows 478. The shield mating contacts 416 of one contact module 128 or 302 may be aligned with the shield mating contacts 416 of other contact modules 128 or 302 along shield contact rows 480. The header assembly 104 has a row pitch 482 between the contact rows 478 and the shield contact rows 480. In one exemplary embodiment, the row pitch 482 may be 0.7 mm, however other pitches are possible in alternative embodiments.

Figure 15:
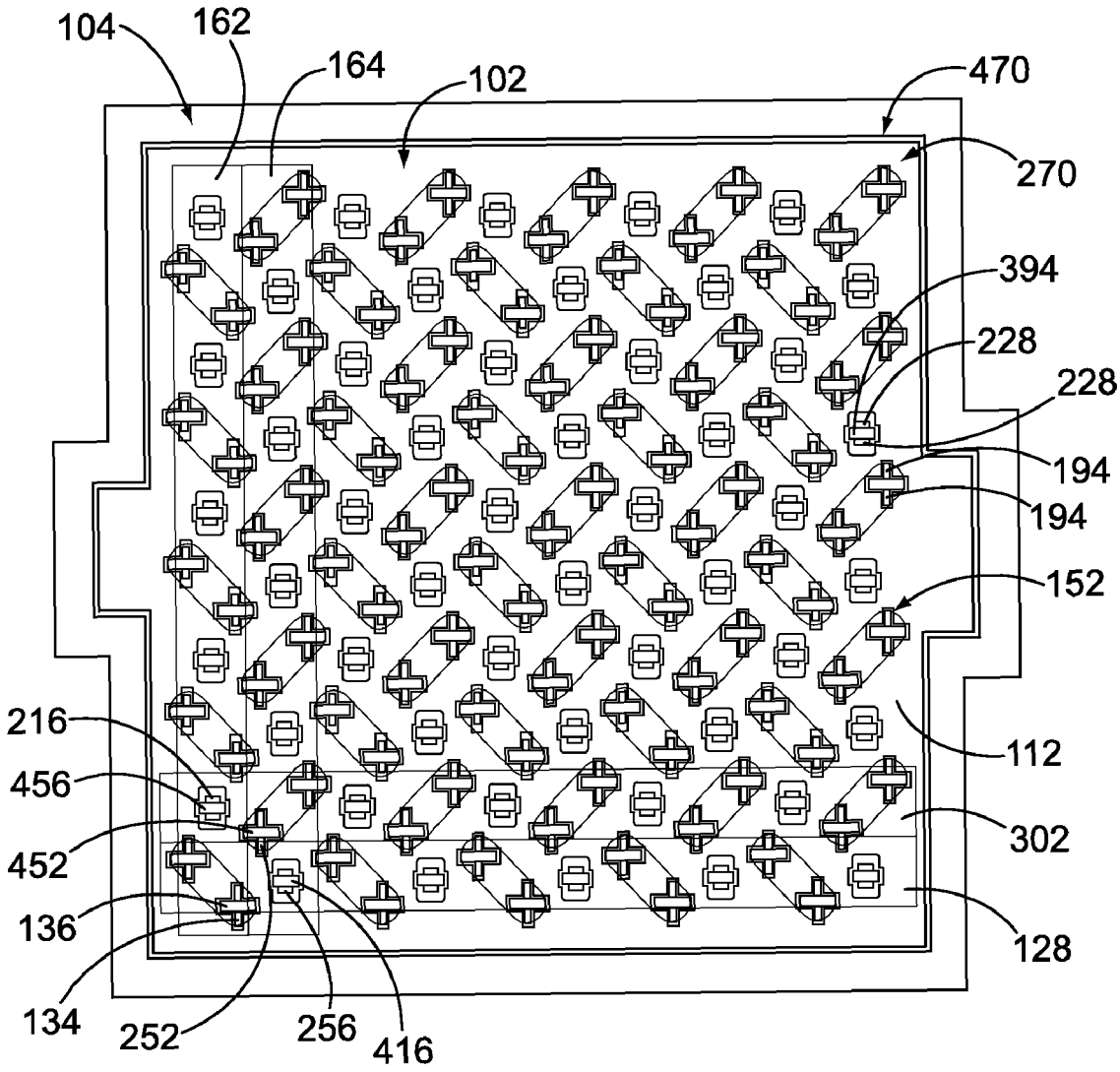
FIG. 15 illustrates a section of the receptacle assembly and header assembly in a mated position through the mating interfaces thereof.

FIG. 15 illustrates a section of the receptacle assembly 102 and header assembly 104 in a mated position through the mating interfaces 270, 470 thereof. FIG. 15 also illustrates in phantom an outline of an "A" type contact module 162 and a "B" type contact module 164 of the receptacle assembly 102 and an outline of an "A" type contact module 128 and a "B" type contact module 302 of the header assembly 102. The contact modules 162, 128 are oriented orthogonal with respect to one another. The contact modules 164, 302 are oriented orthogonal with respect to one another. Each of the signal pairs are illustrated by oval phantom lines surrounding the corresponding mating contacts 134, 136 and 252, 452.

With reference to the "A" type contact modules 162, 128, the mating contacts 136 include the beams 194 that engage the sides 394 of the mating contacts 134. Both of the mating contacts 134, 136 are received in the contact channels 152 of the housing 112 of the receptacle assembly 102. The contact channels 152 may guide the mating contacts 134 into the gap 222 (shown in FIG. 6) between the beams 194 to facilitate electrically connecting the mating contacts 134 to the mating contacts 136. Similarly, the shield mating contacts 216 include the fingers 228 that engage the corresponding shield mating contacts 416.

Each of the "A" type contact modules 162, 128 have one shared or common pair of mating contacts 134, 136. Each of the "B" type contact modules 164, 302 have one shared or common pair of mating contacts 252, 452. Each "A" type contact module 162 has a shield mating contact 216 that mates with a shield mating contact 456 of a "B" type contact module 302. Each "B" type contact module 164 has a shield mating contact 256 that mates with a shield mating contact 416 of an "A" type contact module 128. Each "A" type contact module 128 has a shield mating contact 416 that mates with a shield mating contact 256 of a "B" type contact module 164. Each "B" type contact module 302 has a shield mating contact 456 that mates with a shield mating contact 216 of an "A" type contact module 162.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the fill scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An orthogonal connector system for connecting a first circuit board and a second circuit board oriented orthogonally with respect to the first circuit board, the orthogonal connector system comprising:

a receptacle assembly and a header assembly mated with the receptacle assembly, the receptacle assembly being connected to the first circuit board and the header assembly being connected to the second circuit board, the receptacle assembly and the header assembly both have a housing and contact modules held within the corresponding housing, the contact modules have conductors extending along a conductor plane between contact tails and mating contacts, the contact tails extending from a mounting edge thereof, the contact tails of the receptacle connector being connected to the first circuit board and the contact tails of the header assembly being connected to the second circuit board, the mating contacts extending from a mating edge thereof, the mating contacts arranged in pairs with one mating contact of each pair being transitioned to one side of the contact plane and the other mating contact of each pair being transitioned to the opposite side of the conductor plane, the mating edges being generally orthogonal with respect to the mounting edges;

wherein the mating contacts of the receptacle assembly are directly connected to the mating contacts of the header assembly, and wherein the mounting edge of the receptacle assembly is generally orthogonal with respect to the mounting edge of the header assembly.

2. The system of claim 1, wherein adjacent mating contacts of each contact module are offset with respect to one another such that adjacent mating contacts are not aligned with one another.

3. The system of claim 1, wherein the housing of the receptacle assembly has a mating face, the receptacle assembly is connected to the first circuit board such that the mating face of the receptacle assembly is orthogonal to the first circuit board, and wherein the housing of the header assembly has a mating face, the header assembly is connected to the second circuit board such that the mating face of the header assembly is orthogonal to the second circuit board.

4. The system of claim 1, wherein the conductors are right angle conductors that have transition sections, the transition sections being coplanar with the conductor plane.

5. The system of claim 1, wherein the contact tails extend in a first direction from the mounting edge, the mating contacts extend in the second direction from the mating edge, the second direction is generally perpendicular with respect to the first direction.

6. The system of claim 1, wherein the contact tails of the receptacle assembly and the contact tails of the header assembly are configured to transmit signals across only one mating interface defined by the corresponding mating contacts.

7. The system of claim 1, wherein the conductors are arranged in pairs, the pairs of conductors carry differential pair signals, each contact module carries more than one pair of conductors.

8. The system of claim 1, wherein the contact modules of the receptacle assembly are each aligned with one another along parallel receptacle assembly contact module planes, the contact modules of the header assembly are each aligned with one another along parallel header assembly contact module planes, the receptacle assembly contact module planes are perpendicular to the header assembly contact module planes.

9. The system of claim 1, wherein the contact modules of the receptacle assembly are each aligned with one another along parallel receptacle assembly contact module planes, the contact modules of the header assembly are each aligned with one another along parallel header assembly contact module planes, the receptacle assembly contact module planes are parallel to the second circuit board and the header assembly contact module planes are parallel to the first circuit board.

10. The system of claim 1, wherein the pairs of mating contacts of one contact module of the receptacle assembly are mated with corresponding pairs of mating contacts of more than one contact module of the header assembly, and wherein the pairs of mating contacts of one contact module of the header assembly are mated with corresponding pairs of mating contacts of more than one contact module of the receptacle assembly.

11. A connector assembly for an orthogonal connector system used to interconnect circuit boards oriented orthogonally with respect to one another, the connector assembly comprising:

a housing having a mating face; and contact modules held within the housing, the contact modules each have a contact module body including a mating edge and a mounting edge that is orthogonal to the mating edge, the contact modules each have conductors held by the corresponding contact module body along a conductor plane, contact tails extend from the conductors at the mounting edge for connection to a circuit board, mating contacts extend from the conductors at the mating edge and include a mating portion configured for mating with corresponding mating contacts of a corresponding mating connector assembly;

wherein the mating contacts are offset out of the conductor plane such that the mating portions of adjacent mating contacts are arranged on opposite sides of the conductor plane.

12. The connector assembly of claim 11, wherein the mating contacts are arranged in pairs, the mating contacts of each pair are configured to carry differential signals, the mating contacts of each pair are offset in different directions such that the mating contacts are arranged on different sides of the conductor plane.

13. The connector assembly of claim 11, wherein the mating contacts are arranged in pairs, the mating contacts of each pair are configured to carry differential signals, the mating contacts extend along a mating axis, wherein a contact bisecting plane defined between the mating axes of the mating contacts within the pairs of mating contacts is oriented at approximately a 45° angle with respect to the conductor plane.

14. The connector assembly of claim 11, wherein the contact module body includes opposed the first and second sides, the mating contacts are transitioned out of the conductor plane towards one of the first or second side of the contact module body.

15. The connector assembly of claim 11, wherein the mating portion extends along a mating plane parallel to, and non-coplanar with, the conductor plane.

16. The connector assembly of claim 11, wherein the contact tails are coplanar with the conductor plane.

17. The connector assembly of claim 11, wherein the contact module body is overmolded over the conductors.

18. A connector assembly comprising:

a housing having a mating face;

contact modules held within the housing, the contact modules each have a contact module body including opposed first and second sides, a mating edge and a mounting edge that is orthogonal to the mating edge, the contact modules each have conductors held by the corresponding contact module body along a conductor plane, contact tails extend from the conductors at the mounting edge for connection to a circuit board, mating contacts extend from the conductors at the mating edge, wherein the mating contacts are offset out of the conductor plane such that the mating portions of adjacent mating contacts are arranged on opposite sides of the conductor plane; and a shield connected to the first side, the shield having a mating edge and a mounting edge, the shield having shield tails extending from the mounting edge of the shield for connection to a circuit board, and the shield having shield mating contacts extending from the mating edge of the shield.

19. The connector assembly of claim 18, wherein the shield is parallel to, and generally non-coplanar with, the conductor plane, and wherein the shield tails are substantially coplanar with the conductor plane.

20. The connector assembly of claim 18, wherein the shield mating contacts have a different shape than the mating contacts.

* * * * *